United States Patent [19]

Zanarini

[11] Patent Number: 4,761,118

[45] Date of Patent: Aug. 2, 1988

[54] POSITIVE DISPLACEMENT HYDRAULIC-DRIVE RECIPROCATING COMPRESSOR

[76] Inventor: Franco Zanarini, Via Curiel, 27, Castelmaggiore (Bologna), Italy, 40013

[21] Appl. No.: 827,823

[22] Filed: Feb. 7, 1986

[30] Foreign Application Priority Data

Feb. 22, 1985 [IT] Italy ..... 3342 A/85

[51] Int. Cl.[4] ..... F04B 25/04

[52] U.S. Cl. ..... 417/254; 417/393; 417/396; 417/265; 92/85 B; 92/129

[58] Field of Search ..... 417/244, 261-268, 417/254, 255, 393, 396; 92/129, 85 B

[56] References Cited

U.S. PATENT DOCUMENTS 745,298 11/1903 Sergaent ..... 417/266 X
850,589 4/1907 Howard ..... 92/85 B X
2,702,008 2/1955 Stockard ..... 417/267 X
4,390,322 6/1983 Budzich ..... 417/267 X

*Primary Examiner*—Carlton R. Croyle
*Assistant Examiner*—Theodore Olds
*Attorney, Agent, or Firm*—Darby & Darby

[57] ABSTRACT

The invention disclosed relates to the art field embracing positive displacement reciprocating compressors of the type featuring hydraulic drive, and sets out to simplify the construction of such units, rendering them more functional at the same time. Four coaxial bulkheads are adopted, set apart one from the next by three cylinder barrels, and three pistons which are mounted to a common rod and reciprocated thus, each in its respective barrel; the central piston and barrel are of either greater or smaller diameter than the remainder. Hydraulic oil from a power pack driving the compressor flows alternately into chambers which are occupied by the rod, and bounded at one end by one of the pistons of smaller or greater diameter.

12 Claims, 3 Drawing Sheets

POSITIVE DISPLACEMENT HYDRAULIC-DRIVE RECIPROCATING COMPRESSOR

BACKGROUND OF THE INVENTION

The invention relates to positive displacement reciprocating compressors of the type having at least two compression stages arranged in series.

For some time now the prior art has embraced hydraulically-driven positive compressors of the reciprocating type, generally consisting of three coaxial bulkheads between which two coaxial cylinder barrels are located.

Each barrel accommodates a relative piston which strokes, fluid-tight, connected to the remaining piston by a rod; two chambers are thus enclosed by the pistons, the cylinder barrels and the central bulkhead, into which hydraulic oil is pumped, thereby creating a double-acting fluid power cylinder. The remaining two enclosures at either end, created by the pistons, the barrels and the outer bulkheads, or end caps, provide compression chambers.

Such compressors are utilized for the purpose of raising gas from a given initial pressure, which may be atmospheric, to ultra high pressure.

Gases are compressible; it follows therefore that an increase in pressure signifies reduction in volume, to a degree dependent on the final pressure that must be reached. This final pressure is arrived at gradually, for obvious reasons of bulk, employing either multi-stage compressors or a string of single compressors.

Problems with prior art compressors are encountered mainly at low pressure; in the first stage in particular, large bores are required in order to produce powerful suction as a result of the running speed, which is relatively low, especially when compared with mechanically-driven compressors.

Conversely, force required to compress the gas is significantly small, and with hydraulic oil constantly entering at the same high pressure, the need arises for a drastic reduction in the surface area of the piston on which this oil impinges. Such a requirement is met currently by enlarging the diameter of the piston rod; this signifies a considerable increase of the mass set in motion, however.

An increase of the mass set in motion not only renders the compressor singularly heavy, but also limits maximum velocity of the reciprocating components, limiting performance as a result.

Another problem encountered with prior art compressors is that, in the light of the above circumstances, it becomes necessary to employ one compressor of some considerable size for the initial stage, and at least one further compressor of more compact dimensions for successive stages.

The object of the invention is to eliminate the drawbacks described above.

SUMMARY OF THE INVENTION

The invention as described in the following specification and as claimed hereinafter, solves the aforementioned problems besetting embodiment of a positive displacement hydraulic drive reciprocating compressor.

Advantages provided by the invention consist essentially in the fact that it becomes possible to integrate a number of stages in a single compressor, whilst utilizing a lesser number of component parts, at the same time employing a piston rod of modest dimensions in order to limit the amount of mass set in motion and increase the velocity of reciprocating parts.

A further advantage of the invention is that one has the possibility, in three-piston compressors at least, of a floating type of connection between the pistons and rod, the effect of which is to produce a cushioning action at the end of each stroke, and a sweeter take-up on the subsequent return. More exactly, the hydraulic oil need not urge the entire assembly of pistons and rod into motion at the start of each stroke, albeit the assembly described herein is of reduced mass when compared with compressors of prior art design, but need shift only the mass of the small piston upon which it impinges.

Only on completion of such axial travel as is permitted by the play existing between piston and rod (the piston already being in motion) will the oil take up the mass of the small diameter rod and the central piston.

Another advantage of the invention is that, adopting the structural features thus intimated, it becomes possible to embody a multi-stage compressor possessing remarkably lightweight characteristics, especially where the reciprocating mass of pistons and rod is concerned.

Yet another advantage stems from the embodiment of a gas compressor according to the invention, namely, the option of taking in an appreciably high pressure at the first stage whilst exploiting the same hydraulic oil pressure control characteristics.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
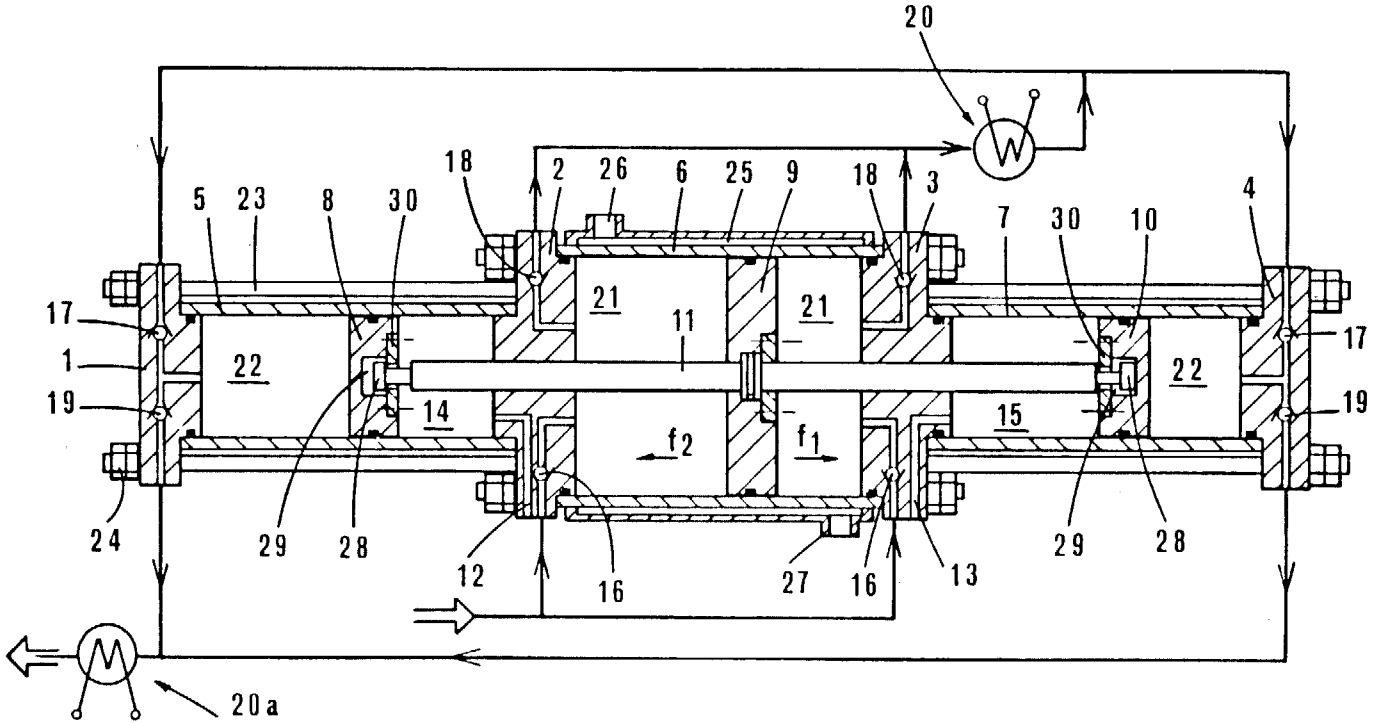
FIG. 1 shows the axial section through an embodiment of a two stage compressor.

With reference to FIG. 1, a first, two-stage embodiment of the positive displacement reciprocating compressor according to the invention consists of four coaxially-disposed bulkheads denoted 1, 2, 3 and 4 viewing from left to right, and three coaxial cylinder barrels, denoted 5, 6 and 7 viewing left to right, located between the bulkheads following the same numerical sequence. The bore of the barrels 5 and 7 at either end is smaller than that of the central barrel 6, and the diameter of the end bulkheads 1 and 4 smaller than that of the central bulkheads 2 and 3, by an amount which is dependent upon the compression ratio required. The four bulkheads 1, 2, 3 and 4 are clamped against the corresponding ends of the three barrels 5, 6 and 7 by conventional means, for example, tie-rods 23 and locknuts 24.

8, 9 and 10 denote respective pistons which reciprocate in fluid-tight fashion within the three barrels 5, 6 and 7, respectively. The three pistons are fitted by conventional means to a common rod 11 which slides back and forth, likewise fluid-tight, accommodated by axial holes in the central bulkheads 2 and 3. The central piston 9 is fixedly associated with the rod 11, whereas the two end pistons 8 and 10 are mounted to the rod in a floating arrangement which may be embodied, say, by providing the rod 11 with end stops 28 accommodated in relative seats 29 offered by the end pistons 8 and 10, which in turn are closed off by centerless disks 30. The length of the rod 11 is such that when either of the end pistons 8 or 10 comes substantially into contact with a relative bulkhead 1 or 4, the central piston 9 will be distanced marginally from the corresponding central bulkhead 2 or 3.

The piston 8 and barrel 5 at one end create two chambers, namely, a high pressure gas chamber 22 and a power chamber 14, the latter accommodating the piston rod 11. Similarly, the piston 10 and barrel 7 at the opposite end create two chambers, likewise, a high pressure gas chamber 22, and a power chamber 15 accommodating the rod 11. The central piston 9 and cylinder barrel 6 create two low pressure gas chambers 21, both of which accommodate the piston rod 11.

The power chambers 14 and 15 connect with relative flow passages 12 and 13 which in their turn connect ultimately with a hydraulic power pack (not illustrated) from which oil under pressure is pumped alternately into the two power chambers 14 and 15; ideally, such flow passages would be located in the adjacent bulkheads 2 and 3.

The low pressure chambers 21 (the first compression stage of a compressor according to the invention) communicate with an external source of gas by way of respective inlet valves 16 located in the central bulkheads 2 and 3, and with a device 20 for cooling compressed gas, by way of respective outlet valves 18 located likewise in the central bulkheads 2 and 3.

The high pressure chambers 22 (the second compression stage in a compressor according to the invention) communicate with the cooling device 20 by way of inlet valves 17 located in the end bulkheads 1 and 4, and with the service (not illustrated) to which compressed gas is supplied, in this instance by way of relative outlet valves 19 located likewise in the end bulkheads 1 and 4, and of a further cooling device 20*a*.

The three cylinder barrels 5, 6 and 7 are cooled by conventional methods; in the drawing, the central barrel 6 is provided with a jacket 25 connecting by way of respective ports 26 and 27 with a circuit (not illustrated) through which coolant is circulated, whereas the two end barrels 5 and 7 will generally be cooled by the hydraulic oil circulating through the respective power chambers 14 and 15.

A flow of oil under pressure into the left hand power chamber 14 causes the entire piston-and-rod assembly 8, 9, 10 and 11 to shift in the direction denoted f2, bringing about compression in the left hand high and low pressure chambers 22 and 21, and occasioning suction in the right hand high and low pressure chambers 22 and 21. Similarly, flow of oil into the right hand power chamber 15 causes the pistons and rod 8-9-10-11 to shift in the direction denoted f1, bringing about an inversion of the compression and suction strokes in the high pressure chambers 22 and the low pressure chambers 21.

At the start of each compression stroke, the end piston will be positioned 8 adjacent to the central bulkhead 2 and butted against the relative end of the rod 11. Oil entering the chamber 14 finds its way immediately between the end stop 28 of the rod and the seat 29 in the piston 8 with the result that the piston 8 alone shifts in the direction marked f2 toward the end bulkhead 1, while the rod 11 and the central piston 9 remain substantially motionless. Once the disk 30 is brought into contact with the stop 28, the piston 8 begins pulling, and draws with it the rod 11 and the central piston 9, assisted in so doing by the opposite end piston 10 which imparts thrust by reason of the force of gas entering the right-hand high pressure chamber 22.

Arrival of the left-hand piston 8 up against the end bulkhead 1 is accompanied by a sharp rise in oil pressure within the power chamber 14; this rise in pressure is exploited for the purpose of relaying a signal to a conventional device controlling stroke inversion, and the flow of hydraulic oil is switched to the right hand power chamber 15 accordingly. During inversion, the rod 11 and central piston 9 will continue to travel until such time as the piston 9 is gradually slowed up by resistance of the gas in the left hand low pressure chamber 21; the gas thus provides a cushioning effect which markedly reduces piston slam.

The sequence now repeats at the right hand end in the same fashion as explained for the piston denoted 8; a description is therefore superfluous.

To obtain a given degree of adjustment on the cushioning effect provided by relative movement between the end stops 28 of the rod 11 and the seats 29 of the end pistons 8 and 10, use might be made of appropriately calibrated restrictions incorporated either into the pistons 8 and 10 or into the rod 11.

Figure 2:
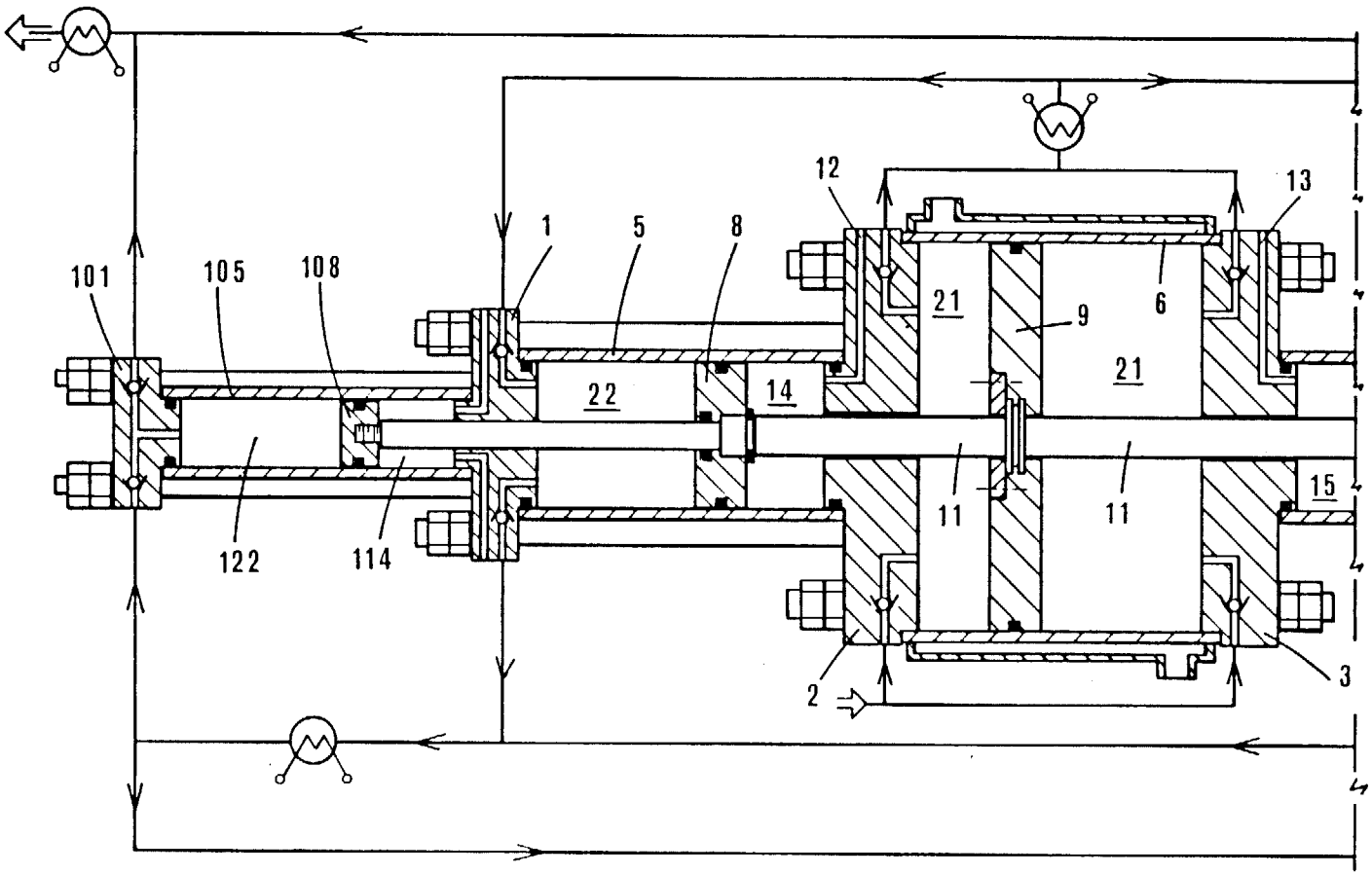
FIG. 2 shows part of the similar section through an embodiment of a three stage compressor the design of which is identical to the compressor of FIG. 1.

A compressor according to the invention may also be embodied in three stages (as illustrated in FIG. 2) by adoption of two end barrels 5 and 105 with relative bulkheads 1 and 101 and pistons 8 and 108, added to each end of the central cylinder barrel 6, rather than one only. In this instance, the pistons could be fixedly associated with the rod 11 throughout (as in FIG. 2) or otherwise; clearly, the one rod serves all three stages. There will be four power chambers in such an embodiment rather than two, and these are denoted 14, 15, 114 and 115 (115 is not illustrated in the drawing, being identical to 114); the connections between the various chambers remain exactly the same as already described, with the sole difference that gas exiting from the second stage is taken into the third stage compression chamber 122 instead of being directed into the service (or into another compressor).

Figure 3:
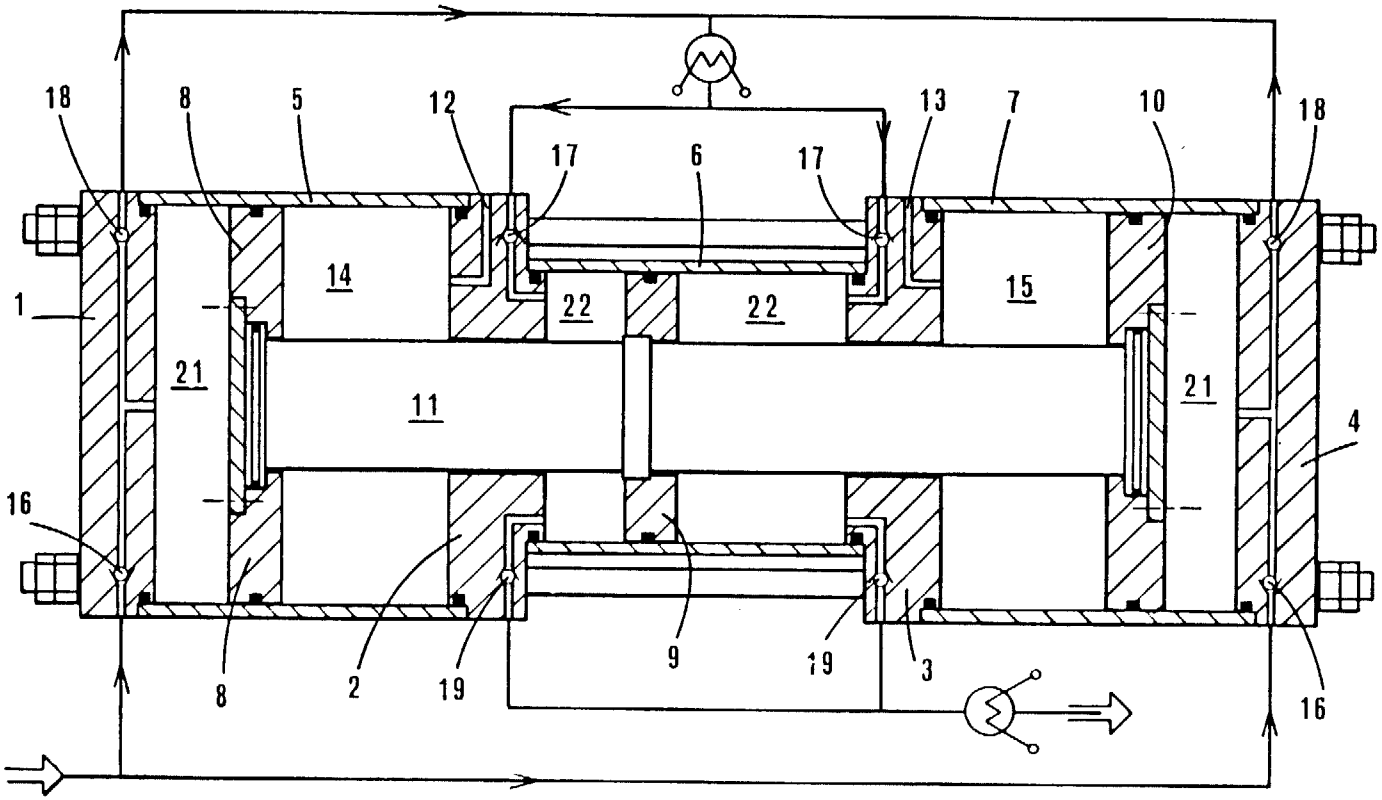
FIG. 3 is a schematic representation of the section through an alternative embodiment of the two-stage compressor in FIG. 1.

Lastly, FIG. 3 illustrates the embodiment of a two stage compressor in which the stages are inverted in relation to the embodiment o FIG. 1, that is, with low pressure chambers 21 located externally of the high pressure chambers 22; power chambers 14 and 15 remain disposed as before. Such an embodiment would be adopted where the initial intake pressure of a gas (flowing into chamber 21) is somewhat high, and the need consequently exists for a larger piston area, pressure of the impinging oil in chambers 14 and 15 being considered as par.

Thus, with the compressor as disclosed, one is able to cover a wide range of intake pressures (between 45–60 psi, with the embodiment of FIG. 1, and between 220–300 psi, with that of FIG. 3) and produce high output pressures (utilizing the three-stage embodiment of FIG. 2, for example).

What is claimed:

1. A positive hydraulic-drive reciprocating compressor, comprising:

at least four coaxially-disposed bulkheads and at least three coaxial cylinder barrels located between the four bulkheads;

at least three pistons reciprocated in fluid-tight fashion each in a respective barrel, of which a central piston and relative barrel are of greater diameter and bore than the remaining outer pistons and barrels and, together with at least two relative bulkheads, create at least two low pressure chambers;

a rod interconnecting the pistons and accommodated slidably and in fluid-tight association by passages located in the central bulkheads;

flow passages communicating with power chambers, and with a hydraulic power pack driving the piston-and-rod assembly, wherein such power chambers each accommodated the piston rod and are bounded, on the one hand, by one of the outer pistons, and on the other, by a corresponding central bulkhead;

gas inlet valves which connect the low pressure chambers with a source of gas and with at least one pair of high pressure chambers, said high pressure chambers being bounded by outer ones of said barrels and corresponding ones of said outer pistons, and outlet valves which connect the one pair of high pressure chambers with at least one further pair of compression chambers, or with services to which compressed gas is to be supplied.

2. A positive displacement hydraulic-drive reciprocating compressor, comprising:

a plurality of coaxially disposed bulkheads, a plurality of coaxial cylinder barrels positioned between said bulkheads, at least two of said cylinder barrels defining both two power chambers and two high pressure gas chambers, each said barrel slidably receiving pistons, a rod interconnecting said pistons, said rod passing through said bulkheads in a fluid sealed manner, at least one central low pressure chamber is defined by one said cylinder barrel and two bulkheads, said low pressure chamber slidably receiving a piston having a greater diameter than the other pistons, at least one flow passage communicating with each power chamber, and with a hydraulic power pack driving said pistons and rod, said flow passages disposed symmetrically with respect to said central low pressure chamber, gas inlet valves connecting the central low pressure chamber with a source of gas and at least with said two high pressure chambers, outlet valves connecting said two high pressure chambers with at least two compressing chambers and with a consumer of a compressed fluid.

3. Compressor as in any of claims 2 or 1, wherein said piston and barrel diameters are chosen to correspond to a predetermined compression ratio.

4. A compressor according to claim 2 having an even number of said bulkheads.

5. A compressor according to claim 4 having four said bulkheads.

6. A compressor according to claim 2 having odd number of said cylinder barrels.

7. A compressor according to claim 6 having at least three said cylinder barrels.

8. Compressor as in any of claims 2 or 1, wherein the two outer pistons are mounted on the rod in a floating arrangement.

9. Compressor as in claim 3, wherein the floating arrangement between rod and pistons includes restrictions designed to permit a metered passage of hydraulic oil into the poer chambers.

10. Compressor as in any of claims 2 or 1, which in a double two-stage version is embodied substantially symmetrical in relation to the central position.

11. Compressor as in any of claims 2 or 1, wherein the flow passages are incorporated into the central bulkheads.

12. A positive hydraulic-drive reciprocating compressor, comprising:

at least four coaxially-disposed bulkheads and at least three coaxial cylinder barrels located between the four bulkheads;

at least three pistons reciprocated in fluid-tight fashion each in a respective barrel, of which a central piston and relative barrel are of lesser diameter and bore than the remaining outer pistons and barrels and, together with at least two relative bulkheads, create at least two low pressure chambers;

a rod interconnecting the pistons and accomodated slidably and in fluid-tight association by passages located in the central bulkheads;

flow passages communicating with power chambers, and with a hydraulic power pack driving the piston-and-rod assembly, wherein such power chambers each accomodate the piston rod and are bounded, on the one hand, by one of the outer pistons, and on the other, by a corresponding central bulkhead;

gas inlet valves which connect the low pressure chambers with a source of gas and with at least one pair of high pressure chambers, and outlet valves which connect the one pair of high pressure chambers with at least one further pair of compression chambers, or with services to which compressed gas is to be supplied.

* * * * *